US006661326B2

(12) United States Patent
Yeh et al.

(10) Patent No.: US 6,661,326 B2
(45) Date of Patent: Dec. 9, 2003

(54) WIRE-WINDING STRUCTURE AND METHOD FOR A TRANSFORMER

(75) Inventors: Ming Yeh, Banchiau (TW); Heng Cheng Chou, Shinjuang (TW); Chen-Feng Wu, Bade (TW)

(73) Assignee: Delta Electronics, Inc., Taoyuan Sien (TW)

( * ) Notice: Subject to any disclaimer, the term of this patent is extended or adjusted under 35 U.S.C. 154(b) by 54 days.

(21) Appl. No.: 10/114,715

(22) Filed: Apr. 1, 2002

(65) Prior Publication Data

US 2002/0145498 A1 Oct. 10, 2002

(30) Foreign Application Priority Data

Apr. 4, 2001 (TW) ..... 90108055 A

(51) Int. Cl.[7] ..... H01F 27/30; H01F 5/00
(52) U.S. Cl. ..... 336/208; 336/192; 336/198
(58) Field of Search ..... 336/208, 198, 336/192; 29/602.1

(56) References Cited

U.S. PATENT DOCUMENTS 4,904,975 A * 2/1990 Medenbach ..... 336/192
5,696,477 A * 12/1997 Yamamori et al. ..... 336/192
6,078,240 A * 6/2000 Huang ..... 336/90

* cited by examiner

*Primary Examiner*—Anh T Mai
(74) *Attorney, Agent, or Firm*—Thomas, Kayden, Horstemeyer & Risley

(57) ABSTRACT

A wire-winding structure and method are applied to a transformer to improve transformer power. The wire-winding method includes the following steps. A bobbin which includes a plurality of pins and a plurality of slots on the external surface is provided. A wire is wound from a first pin and successively wound on the rest of the plurality of slots, but not on a slot adjacent to a predetermined connection portion between iron core structures of the transformer. The wire is soldered to a second pin and the bobbin with the winding wire is combined with the iron core structures to constitute the transformer.

9 Claims, 2 Drawing Sheets

WIRE-WINDING STRUCTURE AND METHOD FOR A TRANSFORMER

BACKGROUND OF THE INVENTION

1. Field of the Invention

The present invention relates to a wire-winding structure and a wire-winding method, and more particularly to a wire-winding structure and wire-winding method applied to a transformer.

2. Description of the Prior Art

Please refer to FIG. 1A, showing a bobbin 1 of a conventional transformer. The bobbin 1 includes a primary winding side 11 and a secondary winding side 12. A plurality of slots 14 are formed in the secondary winding side 12. A plurality of pins 15 are disposed at two ends of the base 13 of the bobbin 1 to be connected with a printed circuit board at users' end. Conventional winding way of the bobbin is shown in FIG. 1B. The wire is wound on the slots 14. Specifically speaking, the wire is first soldered to a starting pin 151. After winding on the first slots 14, the wire traverses a wire-traversing groove 16 and then is wound on the second and third slots. After the entire array of slots is wound with the wire, the wire is pulled back through a wire-traversing structure 17 to a pin 152 and soldered to the pin 152. The bobbin 1 with winding wire is then combined with two E-type iron core structures 18 to constitute the transformer.

However, there is a gap formed at the connection portion between the two iron core structures. Thus, when the magnetic field encounters different media (space or glue), instability is generated. This affects the windings, and causes loss of transformer power.

SUMMARY OF THE INVENTION

The object of the present invention is to solve the above-mentioned problems by providing a wire-winding structure and method for a transformer. The transformer power is thereby enhanced.

According to a first aspect of the present invention, the wire-winding method applied to a transformer includes the following steps. A bobbin which includes a plurality of pins and a plurality of slots formed on the external surface is provided. A wire is wound from a first pin and successively wound on the rest of the plurality of slots, but not on the slot adjacent to a predetermined connection portion between iron core structures of the transformer. The wire is soldered to a second pin and the bobbin with the winding wire is combined with the iron core structures to constitute the transformer.

Preferably, the bobbin can include a primary winding side and a secondary winding side, and the plurality of slots are formed on the secondary winding side. The bobbin is provided with a plurality of outwardly protruding insulating flanges on the external surface of the bobbin to form the plurality of slots.

Moreover, the bobbin includes a base, and the plurality of pins are disposed at two ends of the base for connection to a printed circuit board.

According to another aspect of the present invention, the wire-winding structure of the transformer includes a bobbin and the bobbin is provided with a plurality of slots on the external surface of the bobbin. The slots are wound with a wire, but a slot adjacent to a predetermined connection portion between iron core structures of the transformer is not wound with the wire.

BRIEF DESCRIPTION OF THE DRAWINGS

The present invention will become more fully understood from the detailed description given hereinbelow and the accompanying drawings, given by way of illustration only and thus not intended to be limitative of the present invention.

DETAILED DESCRIPTION OF THE PREFERRED EMBODIMENTS

Figure 1A:
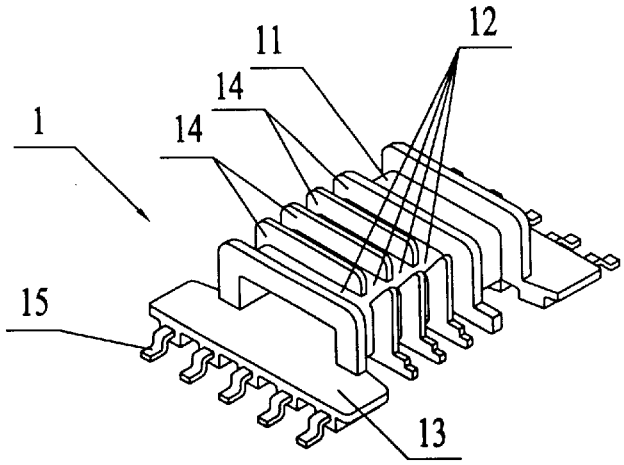
FIG. 1A is a schematic diagram showing a bobbin of a conventional transformer.
Figure 1B:
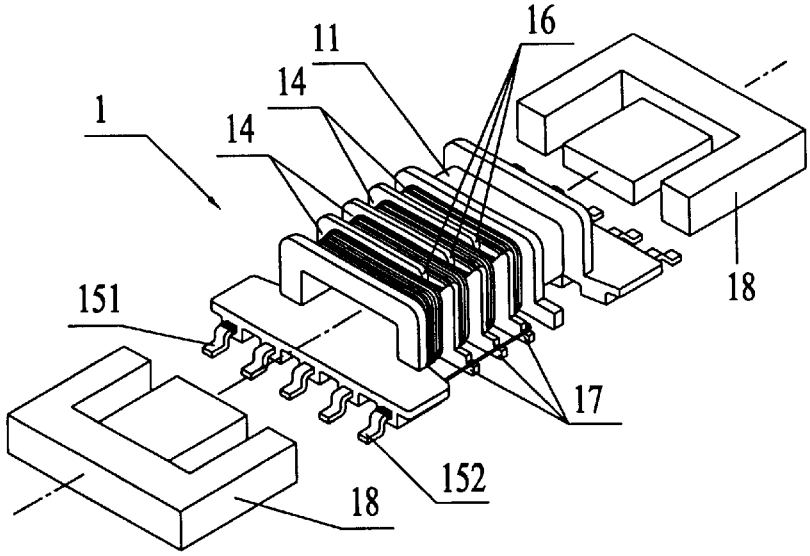
FIG. 1B is a schematic diagram showing the wire-winding method of a bobbin of a conventional transformer.
Figure 2A:
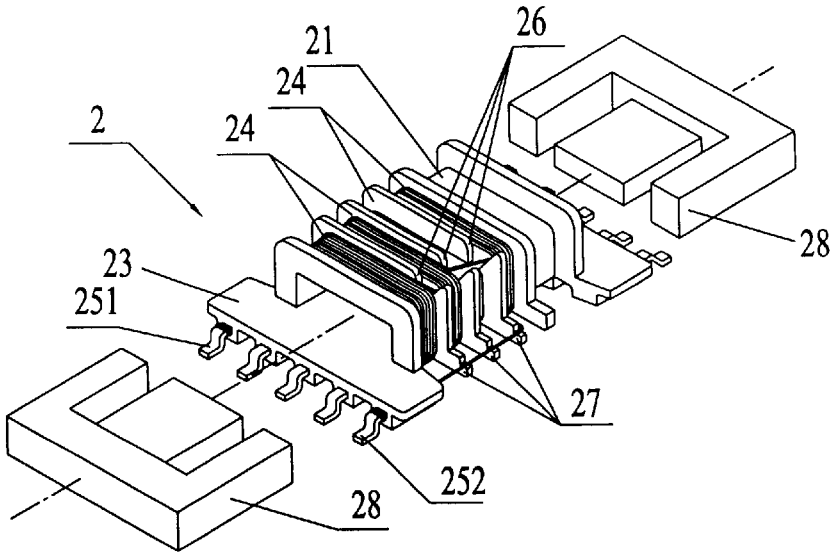
FIG. 2A is a schematic diagram showing the wire-winding method of the transformer of the present invention.
Figure 2B:
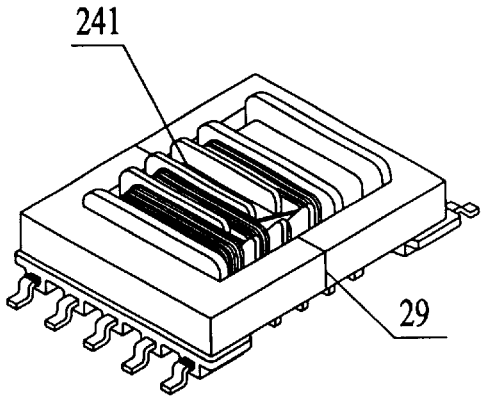
FIG. 2B is a schematic diagram showing the combination of the transformer of the present invention.

The present invention discloses a wire-winding structure and a wire-winding method applied to a transformer. FIG. 2A shows a bobbin according to a preferred embodiment of the present invention, which is used to further describe the technique and feature of the present invention. The bobbin 2 includes a primary winding side 21 and a secondary winding side. In the secondary winding side, a plurality of insulating flanges outwardly protrude from the external surface of the bobbin 2. The secondary winding side is partitioned by the insulating flanges into a plurality of slots 24. A plurality of pins are disposed at two ends of the base 23 of the bobbin 2 for connection to a printed circuit board at the users' end. The wire-winding method is described below. A wire is wound on the slots 24. First, the wire is soldered to a starting pin (or a first pin) 251 and wound on the first slot. After the winding on the first slot is complete, the wire traverses a wire-traversing groove 26 of the insulating flanges, and then is wound on a second slot. The wire is not wound on a slot 241 adjacent to a predetermined connection portion 29 between iron core structures of the transformer (as shown in FIG. 2B), and then is wound on the next slot. Next, the winding continues until the rest of the slots are wound. Next, the wire is pulled back through a wire-traversing structure 27 of the insulating flanges to a soldering pin (or a second pin) 252 and soldered to the second pin 252. Finally, the bobbin 2 with winding wire is combined with two iron core structures 28 to constitute the transformer. Of course, the wire-winding method of the present invention can be applied to a transformer combined by a bobbin and iron core structures with other shapes.

There is a gap formed at the connection portion between the two iron core structures. Thus, when the magnetic field encounters different media (space or glue), instability is generated. This affects the windings, and causes loss of transformer power. To prevent the above problems, the wire is not wound on a slot 241 adjacent to a predetermined connection portion 29 between iron core structures in the present invention. Thus, not only are the various electrical properties of the transformer enhanced, but also the coupling properties of the primary winding side and the secondary winding side are improved. This effectively decreases magnetic leakage of the secondary winding side and decreases the stray capacitance. Transformer power is also enhanced.

The foregoing description of the preferred embodiments of this invention has been presented for purposes of illustration and description. Obvious modifications or variations are possible in light of the above teaching. The embodiments were chosen and described to provide the best illustration of the principles of this invention and its practical application to thereby enable those skilled in the art to utilize the invention in various embodiments and with various modifications as are suited to the particular use contemplated. All such modifications and variations are within the scope of the present invention as determined by the appended claims when interpreted in accordance with the breadth to which they are fairly, legally, and equitably entitled.

What is claimed is:

1. A wire-winding method applied to a transformer, comprising the following steps:

providing a bobbin which includes a plurality of pins and a plurality of slots on the external surface of the bobbin;

winding a wire from a first pin and successively winding the wire on the rest of the plurality of slots, but not on a slot adjacent to a predetermined connection portion between iron core structures of the transformer; and soldering the wire to a second pin and combining the bobbin with the winding wire with the iron core structures to constitute the transformer.

2. The wire-winding method as claimed in claim 1, wherein the bobbin includes a primary winding side and a secondary winding side, and the plurality of slots are formed on the secondary winding side.

3. The wire-winding method as claimed in claim 1, wherein the bobbin includes a base, and the plurality of pins are disposed at two ends of the base for connection to a printed circuit board.

4. The wire-winding method as claimed in claim 1, wherein the bobbin is provided with a plurality of outwardly protruding insulating flanges on the external surface of the bobbin to form the plurality of slots.

5. A wire-winding structure of a transformer, comprising a bobbin, wherein the bobbin is provided with a plurality of slots on the external surface of the bobbin, and the slots are wound with a wire, but a slot adjacent to a predetermined connection portion between iron core structures of the transformer is not wound with the wire.

6. The wire-winding structure of the transformer as claimed in claim 5, wherein the bobbin includes a primary winding side and a secondary winding side, and the plurality of slots are formed on the secondary winding side.

7. The wire-winding structure of the transformer as claimed in claim 5, wherein the bobbin includes a base, and the plurality of pins are disposed at two ends of the base for connection to a printed circuit board.

8. The wire-winding structure of the transformer as claimed in claim 5, wherein the bobbin with winding wire is combined with an iron core structure to constitute the transformer.

9. The wire-winding structure of the transformer as claimed in claim 5, wherein the bobbin is provided with a plurality of outwardly protruding insulating flanges on the external surface of the bobbin to form the plurality of slots.

* * * * *